United States Patent [19]

Hermelin

[11] Patent Number: 4,796,761

[45] Date of Patent: Jan. 10, 1989

[54] MODULABLE OBLIQUE BIN

[75] Inventor: René Hermelin, Trie sur Baïse, France

[73] Assignee: Services Equipments France (S.E.F.), Paris, France

[21] Appl. No.: 603,024

[22] Filed: Apr. 23, 1984

[30] Foreign Application Priority Data

Apr. 22, 1983 [FR] France ..... 83 06679

[51] Int. Cl.[4] ..... B42F 17/00

[52] U.S. Cl. ..... 211/11; 211/184; 211/55

[58] Field of Search ..... 211/11, 10, 184, 52, 211/55, 86, 128, 50; 220/23.4; 206/558

[56] References Cited

U.S. PATENT DOCUMENTS

| | | | |
|---|---|---|---|
| 1,379,790 | 5/1921 | Waterhouse | 211/11 |
| 1,857,305 | 5/1932 | Holliday | 211/55 X |
| 2,309,896 | 2/1943 | Gustafson et al. | 211/184 X |
| 2,751,088 | 6/1956 | Hargett | 211/55 |

*Primary Examiner*—Blair M. Johnson

*Attorney, Agent, or Firm*—Pollock, Vande Sande & Priddy

[57] ABSTRACT

A modulable oblique bin, in particular for the storing of documents, which includes a series of compartments laid out side by side within a container having two parallel vertical walls connected to each other at the lower ends thereof by a horizontal wall. The compartments consist of a plurality of obliquely-oriented divider units nested together and disposed within the container, each dividing unit having first, second, third and fourth planar sections connected together in series in end-to-end relationship to form a unit having a W-shaped cross-section. The adjacent sections are at right angles to each other and form inner and outer corners at the intersection of said sections. The first section extends obliquely upward from the horizontal wall and is the longest of the four sections, the second section is next longest, and the third section is the shortest section. The inner corner formed by the intersection of the third and the fourth sections of the units receives the outer corner formed by the intersection of the first and second sections of the next succeeding divider unit. A final divider unit nests against the last of the divider units having a W-shaped cross-section and consists of first, second and third planar sections which are analogous to the first, second and third sections, respectively, of the units having a W-shaped cross-section. The second section of the final divider unit is provided with a pair of lateral guide means for retaining the fourth section of the immediately preceding divider unit against the lower surface of the second section of the final divider unit.

1 Claim, 2 Drawing Sheets

MODULABLE OBLIQUE BIN

French Pat. No. 2,176,414 in the name of Mr. Drost LARSEN concerns a document sorting bin including at least two units with identical tiers which form the base and top of the bin, respectively, and are interconnected by plates which constitute the lateral partitions of the bin. In this patent, plates in the shape of a Z are used. They are attached to one another in an immovible manner so as to form a series of bins tilted at approximately 15 to 20 degrees, thereby making it possible to improve the support of the flexible collated documents.

The present invention concerns a modulable, oblique bin which makes it possible to achieve results analogous to those provided by the above-mentioned patent but with greater simplicity. In accordance with the invention, the document sorting bins include a series of compartments laid out side by side and which can be inserted into a unit consisting of two parallel vertical walls connected by a single horizontal wall, and are characterized by the fact that: (a) each compartment contains a plate in the shape of a W, the sections of which are at right angles one to another, the first being the longest by far, the third being shorter than the second, and the fourth longer than the third but also shorter than the second; (b) each plate unit can receive the line separating the parts from the neighboring plate; (c) a "finishing piece" consisting of only three parts instead of four, the first of which is identical to the first section of the the above-mentioned plates and the second analogous to the second of the aforesaid plates but with two lateral guides which can, in the course of assembly, be inserted beneath the third part of the last plate in the above-mentioned series, is connected to the last of the preceding plats and supported by its vertical wall against the connected vertical plate.

This extremely simplified system requires no pegs or holes because the interlocking of the bins is obtained by the fact that the last part of each W is inserted beneath the following bin; in this way, a bin automatically locks into the preceding bins by pressing against the last part mentioned; this locking is even stronger if the bin is filled with documents.

The following description of one mode of manufacture of the invention is provided by way of nonrestrictive example only and by reference to the attached drawings, in which.

Figure 1:
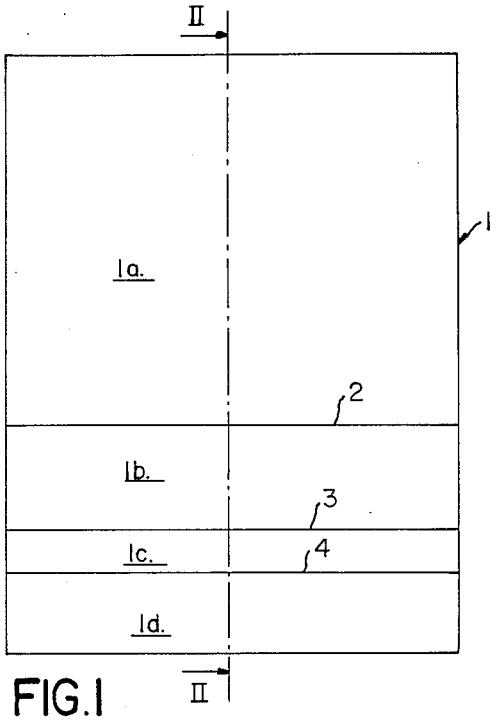
FIG. 1 is the straight ahead view of a bin component on which the different bends to be made are indicated.
Figure 2:
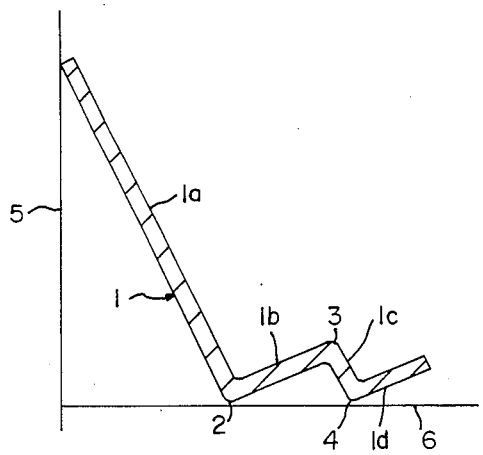
FIG. 2 is a cross section through II—II of FIG. 1.
Figure 3:
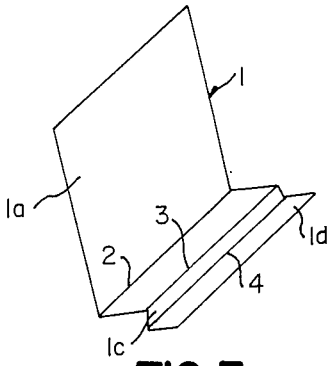
FIG. 3 is a perspective view of one bin component after bending.

FIGS. 1 to 3 show that the bins according to the invention are each formed from a rectangular plate 1, preferably of rigid steel, divided into four parts 1*a*, 1*b*, 1*c* and 1*d* of different heights, separated for purposes of facilitating the manufacture of the plate 1 by lines 2, 3 and 4. The upper part 1*a* is the highest one; the first intermediate part 1*b* is less tall than part 1*a* but taller than part 1*c* (the smallest of the four), and the lower part 1*d* is slightly less tall than part 1*b*. To produce a bin as shown in FIGS. 2 and 3, part 1*b* is bent upward at a right angle around line 2, then part 1*c* is bent downward around line 3 parallel to part 1*a*, and finally part 1*d* is bent perpendicularly to part 1*c* and parallel to part 1*b* around line 4.

At point 5 in FIG. 2, we see part of a vertical wall of a frame designed to hold a set of bins according to the invention, while at 6 is a part of one of the horizontal walls designed to support this bin unit. As in the case of the document sorting bin covered by French Pat. No. 2,176,414 mentioned above, parts 1*a* and 1*c* of each bin are tilted, preferably by about 15 degrees from the vertical, and axes 2 and 4 rest on the horizontal wall 6. FIG. 3 shows a perspective view of plate 1. The later description of the manner of interconnecting the various bins is by reference to FIG. 7.

Figure 4:
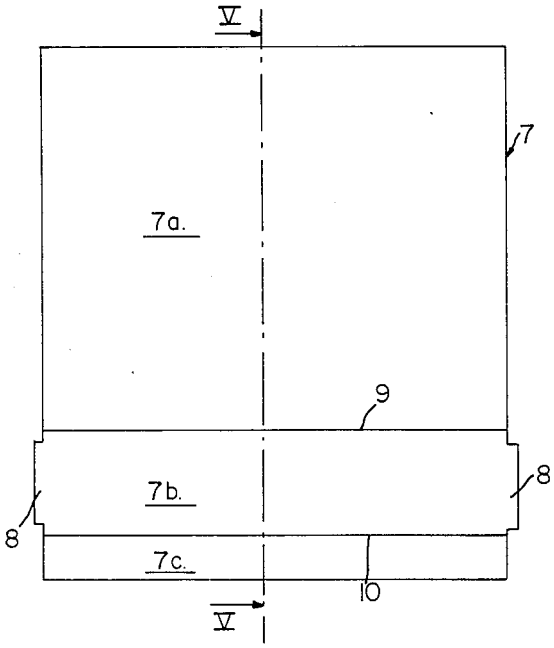
FIG. 4 is analogous to FIG. 1 but illustrates the "finishing piece"
Figure 5:
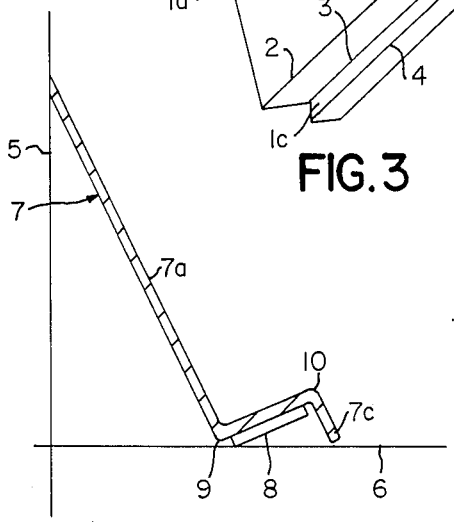
FIG. 5 is a cross section through V—V of FIG. 4.
Figure 6:
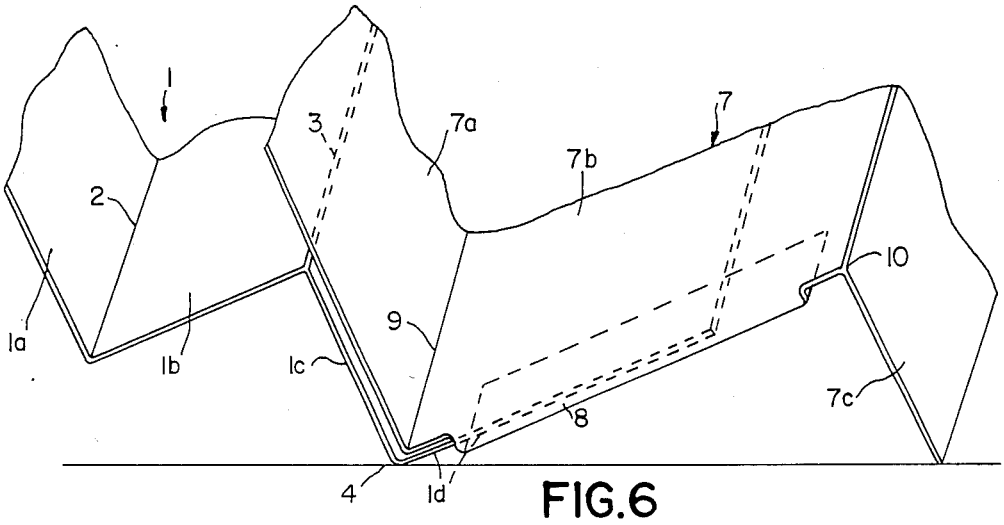
FIG. 6 is a perspective view showing part of the finishing piece and part of the last bin section.

In FIGS. 4 to 6, we see the production of the "finishing piece" which blocks off the end of each series of bins. Plate 7, the "finishing piece," differs from plate 1 in that while it includes an upper part 7*a* of the same height as part 1*a* of plates 1, its parts 7*b* has two guides 8, of a height less than that of the principal part, which are intended to receive part 1*d* of the last of the plates 1 as described below. Part 7*c* is parallel to the wall 7*a* , and identical in height to parts 1*c* of the plates 1. The bends separating parts 7*a* and 7*b* are designated by references 9 and 10, respectively.

Figure 7:
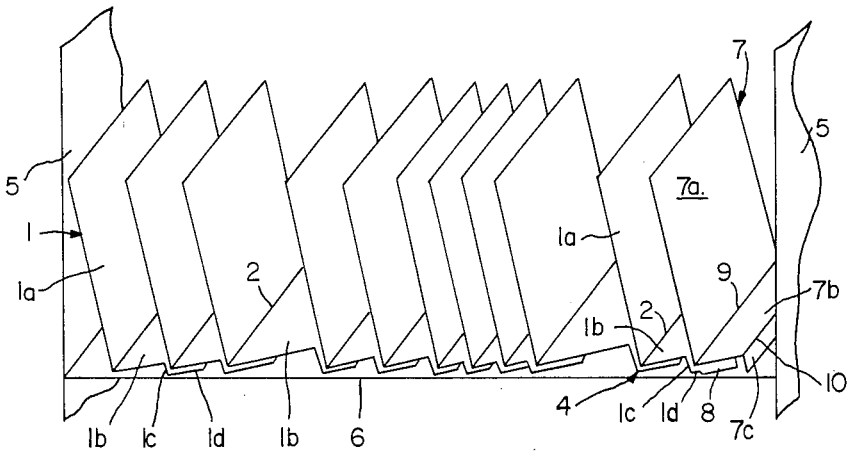
FIG. 7 shows a series of bin sections of different depths.

In practice, when it is sought to permanently attach the bins in a horizontal row, part 7*a* of plate 7 is brought virtually into contact with part 1*c* of the preceding bin, and each of the parts 8 of plate 7*b* is folded back as indicated in FIGS. 5 to 7. Part 1*c* of plate 1 of the preceding bin is practically in contact with part 7*a* of plate 7, while part 1*d* is inserted beneath and practically in contact with part 7*b* of plate 7, with the guides 8 of part 7 sufficing by themselves to hold all the plates 1.

It should be clearly understood that the mode of application described and represented is by way of nonrestrictive example only, and can be modified in numerous small ways without deviating from the subject of the invention as described in the attached claims.

In particular, the bins may be made of any materials whatever, such as wood, plastic, etc., and the bins may be provided with slots to facilitate picking up the documents.

We claim:

1. A series of compartments forming a bin comprising:

a container consisting of two parallel vertical walls connected to each other at the lower ends thereof by a horizontal wall;

a plurality of obliquely-oriented divider units nested together and disposed within said container, each dividing unit comprising first, second, third and fourth planar sections connected together in series in end-to-end relationship to form a unit having a W-shaped cross-section, with adjacent sections being at right angles to each other and forming inner and outer corners at the intersection of said sections, said first section extending obliquely upward from the horizontal wall and being the longest of the four sections, said second section being next longest, and the third section being the shortest section, the inner corner formed by the intersection of said third and said fourth sections of the units receiving the outer corner formed by the intersection of said first and second sections of the next succeeding divider unit; and a final divider unit nesting against the last of the divider units having a W-shaped cross-section consisting of first, second and third planar sections which are analogous to the first, second and third sections, respectively, of the units having a W-shaped cross-section, said second section of the final divider unit being provided with a pair of lateral guide means for retaining the fourth section of the immediately preceding divider unit against the lower surface of said second section of the final divider unit.

* * * * *